United States Patent [19]

Broze et al.

[11] 4,455,249

[45] Jun. 19, 1984

[54] STABILIZED BLEACH AND LAUNDERING COMPOSITION

[75] Inventors: Guy Broze, Grace-Hollogne; Leopold Laitem, Orp-Le-Grand, both of Belgium

[73] Assignee: Colgate-Palmolive Company, New York, N.Y.

[21] Appl. No.: 435,794

[22] Filed: Oct. 21, 1982

[51] Int. Cl.[3] ..... C11D 3/395; C11D 7/54

[52] U.S. Cl. ..... 252/95; 252/99; 252/174.23; 252/174.24; 252/186.38; 252/DIG. 2; 252/DIG. 11

[58] Field of Search ..... 252/95, 99, 174.23, 252/174.24, DIG. 2, DIG. 11, 186.38

[56] References Cited

U.S. PATENT DOCUMENTS

| | | | |
|---|---|---|---|
| 3,920,570 | 11/1975 | Mulders | 252/DIG. 11 |
| 4,079,015 | 3/1978 | Paucot et al. | 252/DIG. 11 |
| 4,079,016 | 3/1978 | Brahm et al. | 252/174.24 |
| 4,259,203 | 3/1981 | Lorquet | 252/174.23 |
| 4,329,244 | 5/1982 | Brichard et al. | 252/99 |

FOREIGN PATENT DOCUMENTS 0027693 4/1981 European Pat. Off. .

*Primary Examiner*—John E. Kittle
*Assistant Examiner*—Hoa Van Le
*Attorney, Agent, or Firm*—Bernard Lieberman; Herbert S. Sylvester; Murray M. Grill

[57] ABSTRACT

A particulate bleaching detergent composition is provided comprising (a) a bleaching agent comprising a peroxyacid compound and/or a water-soluble salt thereof; (b) a polymer containing momomeric units of the formula

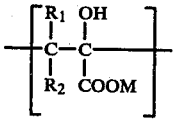

wherein $R_1$ and $R_2$ independently represent hydrogen or an alkyl group containing from 1 to 3 carbon atoms, and M represents hydrogen, or an alkali metal, an alkaline earth metal or ammonium cation: and (c) one or more surface active detergent compounds.

12 Claims, No Drawings

STABILIZED BLEACH AND LAUNDERING COMPOSITION

CROSS REFERENCE TO RELATED APPLICATION

This application is related to copending U.S. application Ser. No. 636-F (A), filed on even date herewith, which describes a particulate bleaching detergent composition containing as the bleaching agent, a peroxygen compound in combination with an activator therefor; a polymer containing momomeric units as described above; and one or more surface active detergent compounds.

BACKGROUND OF THE INVENTION

The present invention relates, in general, to bleaching detergent compositions containing as a bleaching agent a peroxyacid compound, and as a bleaching stabilizer a defined hydroxycarboxylic polymer, and the application of such compositions to laundering operations. More particularly, the present invention relates to particulate bleaching detergent compositions which provide enhanced bleaching performance concomitant with a significant improvement in the stability of the peroxyacid bleaching species in the wash solution owing to the presence of said hydroxycarboxylic polymer.

Bleaching compositions which release active oxygen in the wash solution are extensively described in the prior art and commonly used in laundering operations. In general, such bleaching compositions contain peroxygen compounds, such as, perborates, percarbonates, perphosphates and the like which promote the bleaching activity by forming hydrogen peroxide in aqueous solution. A major drawback attendant to the use of such peroxygen compounds is that they are not optimally effective at the relatively low washing temperatures employed in most household washing machines in the United States, i.e., temperatures in the range of 80° to 130° F. By way of comparison, European wash temperatures are generally substantially higher extending over a range, typically, from 90° to 200° F. However, even in Europe and those other countries which generally presently employ near boiling washing temperatures, there is a trend towards lower temperature laundering.

In an effort to enhance the bleaching activity of peroxygen bleaches, the prior art has employed materials called activators in combination with the peroxygen compounds, such activators usually consisting of carboxylic acid derivatives. It is generally believed that the interaction of the peroxygen compound and the activator results in the formation of a peroxyacid which is a more active bleaching species than hydrogen peroxide at lower temperatures. Numerous compounds have been proposed in the art as activators for peroxygen bleaches among which are included carboxylic acid anhydrides such as those disclosed in U.S. Pat. Nos. 3,298,775; 3,338,839; and 3,532,634; carboxylic esters such as those disclosed in U.S. Pat. No. 2,995,905; N-acyl compounds such as those described in U.S. Pat. Nos. 3,912,648 and 3,919,102; cyanoamines such as described in U.S. Pat. No. 4,199,466; and acyl sulfoamides such as disclosed in U.S. Pat. No. 3,245,913.

The formation and stability of the peroxyacid bleaching species in bleach systems containing a peroxygen compound and an organic activator has been recognized as a problem in the prior art. U.S. Pat. No. 4,255,452 to Leigh, for example, specifically addresses itself to the problem of avoiding the reaction of peroxyacid with peroxygen compound to form what the patent characterizes as "useless products, viz. the corresponding carboxylic acid, molecular oxygen and water". The patent states that such side-reaction is "doubly deleterious since peracid and percompound . . . are destroyed simultaneously." The patentee thereafter describes certain polyphosphonic acid compounds as chelating agents which are said to inhibit the above-described peroxyacid-consuming side reaction and provide an improved bleaching effect. In contrast with the use of these chelating agents, the patentee states that other more commonly known chelating agents, such as, ethylene diamine tetraacetic acid (EDTA) and nitrilotriacetic acid (NTA) are substantially ineffective and do not provide improved bleaching effects. Accordingly, a disadvantage of the bleaching compositions of the Leigh patent is that they necessarily preclude the use of conventional sequestrants, many of which are less expensive and more readily available than the disclosed polyphosphonic acid compounds.

The influence of sodium silicate, a common ingredient in commercial detergent formulations, on the decomposition of peroxyacid in the wash and/or bleaching solution is disclosed in copending applications Ser. Nos. 354,860 and 354,861, filed on Mar. 4, 1982. The undesired loss of the peroxyacid bleaching species in the wash solution by the reaction of peroxyacid with a peroxygen compound (or more specifically, hydrogen peroxide formed from such peroxygen compound) to form molecular oxygen is believed to be catalyzed by the presence of silicates in the wash solution. Conventional sequestrants are believed to be relatively ineffective in inhibiting the aforementioned silicate-catalyzed side reaction. Consequently, the compositions of the invention seek to provide a peroxyacid bleach species having substantially enhanced stability in the wash solution relative to that provided by conventional bleaching detergent compositions, particularly in the presence of silicates.

Hydroxycarboxylic polymers have been disclosed in the art as additives of laundry compositions, principally as sequestrants or builders in detergent compositions, or alternatively as materials which improve the shelf life of certain relatively unstable peroxygen compounds. Thus, for example, U.S. Pat. No. 3,920,570 describes a process for sequestering metal ions from aqueous solution using an alkali metal or ammonium salt of a poly-alpha-hydroxyacrylic acid as a replacement for sodium tripolyphosphate in the detergent composition. U.S. Pat. No. 4,329,244 discloses improving the storage stability of particles of alkali metal percarbonate or perphosphate by incorporating into such particles polylactones derived from defined alpha-hydroxyacylic acid polymers. However, the use of hydroxycarboxylic polymers for improving the stability of peroxyacid bleaching species in an aqueous wash solution has heretofore not been appreciated or disclosed.

SUMMARY OF THE INVENTION

The present invention provides a particulate bleaching detergent composition comprising:

(a) a bleaching agent comprising a peroxyacid compound and/or a water-soluble salt thereof;

(b) from about 0.1 to about 5%, by weight, of a polymer containing momomeric units of the formula

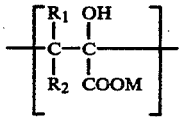

wherein $R_1$ and $R_2$ represent hydrogen or an alkyl group containing from 1 to 3 carbon atoms, and M represents hydrogen, or an alkali metal, an alkaline earth metal or ammonium cation; and (c) at least one surface active agent selected from the group consisting of anionic, cationic, nonionic, ampholytic and zwitterionic detergents.

In accordance with the process of the invention, bleaching of stained and/or soiled materials is effected by contacting such materials with an aqueous solution of the above-defined bleaching detergent composition.

The present invention is predicated on the discovery that the undesired loss of peroxyacid in the aqueous wash solution by the reaction of peroxyacid with a peroxygen compound (or more specifically, hydrogen peroxide formed from the peroxygen compound) to form molecular oxygen is significantly minimized in bleaching systems or wash solutions containing relatively minor amounts of a hydroxycarboxylic polymer in accordance with the invention. Although the applicants do not wish to be bound to any particular theory of operation, it is believed that the the presences of silicates (particularly, water-soluble silicates such as sodium silicate in peroxygen compound activator bleach systems catalyzes the aforementioned reaction of peroxyacid with hydrogen peroxide which results in the loss of active oxygen from the wash solution which would otherwise be available for bleaching, and that such silicate-catalyzed side reaction is substantially minimized in the presence of hydroxycarboxylic polymers as herein described. It has been recognized in the art that metal ions, such as, for example, ions of iron and copper serve to catalyze the decomposition of hydrogen peroxide and also the peroxyacid reaction with hydrogen peroxide. However, with regard to such metal ion catalysis, it has been surprisingly discovered that conventional sequestrants, such as, EDTA or NTA, which the prior art has deemed to be ineffective for inhibiting the aforementioned peroxyacid-consuming side reaction (see, for example, the statement in column 4, lines 30–45 of U.S. Pat. No. 4,225,452) can be incorporated into the compositions of the present invention to stabilize the peroxyacid bleaching species in solution.

DETAILED DESCRIPTION OF THE INVENTION

The polymers used in the present invention are comprised of monomeric units of the formula described above. $R_1$ and $R_2$ which can be identical or different, are preferably both hydrogen, and M is preferably an alkali metal or an ammonium group, most preferably, sodium. Accordingly, in a preferred embodiment of the invention the polymer employed is sodium, poly-alpha-hydroxyacrylate. The degree of polymerization of the polymers is generally determined by the limit compatible with the solubility of the compound in water.

The polymers are employed in the compositions of the invention in sufficient amounts to provide the desired degree of stabilization of the peroxyacid bleaching species in the wash solution. Generally the concentration of polymer in the particulate composition is from about 0.1 to about 5%, by weight of the composition, preferably from about 0.5 to about 3%, and most preferably from about 0.5 to about 2%, by weight.

The hydroxycarboxylic polymers which are used in accordance with the present invention can be prepared by any of numerous processes described in the art. Thus, for example, salts of poly-alpha-hydroxyacrylic acids of the type useful herein and their method of manufacture are extensively described in U.S. Pat. Nos. 3,920,570; 3,994,969; 4,182,806; 4,005,136 and 4,107,411.

The bleaching agent useful in the compositions of the invention comprises a water-soluble peroxyacid compound and/or a water-soluble salt thereof. Peroxyacid compounds can be characterized by the following general formula:

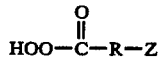

wherein R is an alkyl or alkylene group containing from 1 to about 20 carbon atoms, or a phenylene group, and Z is one or more groups selected from among hydrogen, halogen, alkyl, aryl and anionic groups.

The organic peroxyacids and the salts thereof can contain from about 1 to about 4, preferably 1 or 2, peroxy groups and can be aliphatic or aromatic. The preferred aliphatic peroxyacids include diperoxyazelaic acid, diperoxydodecanedioic acid and monoperoxysuccinic acid. Among the aromatic peroxyacid compounds useful herein, monoperoxyphthalic acid (MPPA), particularly the magnesium salt thereof, and diperoxyterephthalic acid are especially preferred. A detailed description of the production of MPPA and its magnesium salt is set forth on pages 7–10, inclusive, of European Patent Publication No. 0,027,693, published Apr. 29, 1981, the aforementioned pages 7–10 being incorporated herein by reference.

The bleaching agent may optionally also include a peroxygen compound in addition to the peroxyacid compound. The useful peroxygen compounds include compounds that release hydrogen peroxide in aqueous media, such as, alkali metal perborates, e.g., sodium perborate and potassium perobrate, alkali metal perphosphates and alkali metal percarbonates. The alkali metal perborates are usually preferred because of their commercial availability and relatively low cost.

Conventional activators such as those disclosed, for example, at column 4 of U.S. Pat. No. 4,259,200 are suitable for use in conjunction with the aforementioned peroxygen compounds, such disclosure being incorporated herein by reference. The polyacylated amines are generally of special interest, tetraacetyl ethylene diamine (TAED) in particular being a highly preferred activator. For purposes of storage stability, the TAED is preferably present in the compositions of the invention in the form of agglomerates or coated granules which contain the TAED and a suitable carrier material such as a mixture of sodium and potassium tripolyphosphate. Such coated TAED granules are conveniently prepared by mixing finely divided particles of sodium tripolyphosphate and TAED and then spraying onto such mixture an aqueous solution of potassium tripolyphosphate using suitable granulation equipment such as a rotating pan granulator. A typical method of preparation for this type of coated TAED is described in U.S.

Pat. No. 4,283,302 to Foret, et al. The granules of TAED have a preferred particle size distribution as follows: 0–20% greater than 150 micrometers; 10–100% greater than 100 μm but less than 150 μm; 0–50% less than 75 μm; and 0–20% less than 50 μm. Another particularly preferred particle size distribution is where the median particle size of TAED is 160 microns, i.e., 50% of the particles have a size greater than 160 microns. The aforementioned size distributions refer to the TAED present in the coated granules, and not to the coated granules themselves. The molar ratio of peroxygen compound to activator can vary widely depending upon the particular choice of peroxygen compound and activator. However, molar ratios of from about 0.5:1 to about 25:1 are generally suitable for providing satisfactory bleaching performance.

In a preferred embodiment of the invention, the bleaching compositions described herein additionally contain a non-polymeric sequestering agent to enhance the stability of the peroxyacid bleaching compound in solution by inhibiting its reaction with hydrogen peroxide in the presence of metal ions. The term "sequestering agent" as used herein refers to organic compounds which are able to form a complex with $Cu^{2+}$ ions, such that the stability constant (pK) of the complexation is equal to or greater than 6, at 25° C., in water, at an ionic strength of 0.1 mole/liter, pK being conventionally defined by the formula: $pK = -\log K$ where K represents the equilibrium constant. Thus, for example, the pK values for complexation of copper ion with NTA and EDTA at the stated conditions are 12.7 and 18.8, respectively. The sequestering agents employed herein thus exclude inorganic compounds ordinarily used in detergent formulations as builder salts. Accordingly, suitable sequestering agents include the sodium salts of nitrilotriacetic acid (NTA); ethylene diamine tetraacetic acid (EDTA); diethylene triamine pentaacetic acid (DETPA); diethylene triamine pentamethylene phosphonic acid (DTPMP); and ethylene diamine tetramethylene phosphonic acid (EDITEMPA). EDTA is especially preferred for use in the present compositions.

The compositions of the present invention contain one or more surface active agents selected from the group of anionic, nonionic, cationic, ampholytic and zwitterionic detergents.

Among the anionic surface active agents useful in the present invention are those surface active compounds which contain an organic hydrophobic group containing from about 8 to 26 carbon atoms and preferably from about 10 to 18 carbon atoms in their molecular structure and at least one water-solubilizing group selected from the group of sulfonate, sulfate, carboxylate, phosphonate and phosphate so as to form a water-soluble detergent.

Examples of suitable anionic detergents include soaps, such as, the water-soluble salts (e.g., the sodium, potassium ammonium and alkanolammonium salts) of higher fatty acids or resin salts containing from about 8 to 20 carbon atoms and preferably 10 to 18 carbon atoms. Suitable fatty acids can be obtained from oils and waxes of animal or vegetable origin, for example, tallow, grease, coconut oil and mixtures thereof. Particulary useful are the sodium and potassium salts of the fatty acid mixtures derived from coconut oil and tallow, for example, sodium coconut soap and potassium tallow soap.

The anionic class of detergents also includes the water-soluble sulfated and sulfonated detergents having an alkyl radical containing from about 8 to 26, and preferably from about 12 to 22 carbon atoms. (The term "alkyl" includes the alkyl portion of the higher acyl radicals). Examples of the sulfonated anionic detergents are the higher alkyl mononuclear aromatic sulfonates such as the higher alkyl benzene sulfonates containing from about 10 to 16 carbon atoms in the higher alkyl group in a straight or branched chain, such as, for example, the sodium, potassium and ammonium salts of higher alkyl benzene sulfonates, higher alkyl toluene sulfonates and higher alkyl phenol sulfonates.

Other suitable anionic detergents are the olefin sulfonates including long chain alkene sulfonates, long chain hydroxyalkane sulfonates or mixtures of alkene sulfonates and hydroxyalkane sulfonates. The olefin sulfonate detergents may be prepared in a conventional manner by the reaction of $SO_3$ with long chain olefins containing from about 8 to 25, and preferably from about 12 to 21 carbon atoms, such olefins having the formula $RCH{=}CHR_1$ wherein R is a higher alkyl group of from about 6 to 23 carbons and $R_1$ is an alkyl group containing from about 1 to 17 carbon atoms, or hydrogen to form a mixture of sultones and alkene sulfonic acids which is then treated to convert the sultones to sulfonates. Other examples of sulfate or sulfonate detergents are paraffin sulfonates containing from about 10 to 20 carbon atoms, and preferably from about 15 to 20 carbon atoms. The primary paraffin sulfonates are made by reacting long chain alpha olefins and bisulfites. Paraffin sulfonates having the sulfonate group distributed along the paraffin chain are shown in U.S. Pat. Nos. 2,503,280; 2,507,088; 3,260,741; 3,372,188 and German Pat. No. 735,096. Other useful sulfate and sulfonate detergents include sodium and potassium sulfates of higher alcohols containing from about 8 to 18 carbon atoms, such as, for example, sodium lauryl sulfate and sodium tallow alcohol sulfate, sodium and potassium salts of alpha-sulfofatty acid esters containing about 10 to 20 carbon atoms in the acyl group, for example, methyl alpha-sulfomyristate and methyl alphasulfotallowate, ammonium sulfates of mono- or di-glycerides of higher ($C_{10}$–$C_{18}$) fatty acids, for example, stearic monoglyceride monosulfate; sodium and alkylol ammonium salts of alkyl polyethenoxy ether sulfates produced by condensing 1 to 5 moles of ethylene oxide with 1 mole of higher ($C_8$–$C_{18}$) alcohol; sodium higher alkyl ($C_{10}$–$C_{18}$) glyceryl ether sulfonates; and sodium or potassium alkyl phenol polyethenoxy ether sulfates with about 1 to 6 oxyethylene groups per molecule and in which the alkyl radicals contain about 8 to 12 atoms.

The most highly preferred water-soluble anionic detergent compounds are the ammonium and substituted ammonium (such as mono, di and tri-ethanolamine), alkali metal (such as, sodium and potassium) and alkaline earth metal (such as, calcium and magnesium) salts of the higher alkyl benzene sulfonates, olefin sulfonates and higher alkyl sulfates. Among the above-listed anionics, the most preferred are the sodium linear alkyl benzene sulfonates (LABS).

The nonionic synthetic organic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxyethylene chain can be readily adjusted to achieve the desired balance between the hydrophobic and hydrophilic groups.

The nonionic detergents include the polyethylene oxide condensate of 1 mole of alkyl phenol containing from about 6 to 12 carbon atoms in a straight or branched chain configuration with about 5 to 30 moles of ethylene oxide. Examples of the aforementioned condensates include nonyl phenol condensed with 9 moles of ethylene oxide; dodecyl phenol condensed with 15 moes of ethylene oxide; and dinonyl phenol condensed with 15 moles of ethylene oxide. Condensation products of the corresponding alkyl thiophenols with 5 to 30 moles of ethylene oxide are also suitable.

Of the above-described types of nonionic surfactants, those of the ethoxylated alcohol type are preferred. Particularly preferred nonionic surfactants include the condensation product of coconut fatty alcohol with about 6 moles of ethylene oxide per mole of coconut fatty alcohol, the condensation product of tallow fatty alcohol with about 11 moles of ethylene oxide per mole of tallow fatty alcohol, the condensation product of a secondary fatty alcohol containing about 11–15 carbon atoms with about 9 moles of ethylene oxide per mole of fatty alcohol and condensation products of more or less branched primary alcohols, whose branching is predominantly 2-methyl, with from about 4 to 12 moles of ethylene oxide.

Zwitterionic detergents such as the betaines and sulfobetaines having the following formula are also useful:

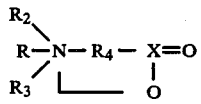

wherein R is an alkyl group containing from about 8 to 18 carbon atoms, $R_2$ and $R_3$ are each an alkylene or hydroxyalkylene group containing about 1 to 4 carbon atoms, $R_4$ is an alkylene or hydroxyalkylene group containing 1 to 4 carbon atoms, and X is C or S:O. The alkyl group can contain one or more intermediate linkages such as amido, ether, or polyether linkages or nonfunctional substituents such as hydroxyl or halogen which do not substantially affect the hydrophobic character of the group. When X is C, the detergent is called a betaine; and when X is S:O, the detergent is called a sulfobetaine or sultaine.

Cationic surface active agents may also be employed. They comprise surface active detergent compounds which contain an organic hydrophobic group which forms part of a cation when the compound is dissolved in water, and an anionic group. Typical cationic surface active agents are amine and quaternary ammonium compounds.

Examples of suitable synthetic cationic detergents include: normal primary amines of the formula $RNH_2$ wherein R is an alkyl group containing from about 12 to 15 atoms; diamines having the formula $RNHC_2H_4NH_2$ wherein R is an alkyl group containing from about 12 to 22 carbon atoms, such as N-2-aminoethyl-stearyl amine and N-2-aminoethyl myristyl amine; amide-linked amine such as those having the formula $R_1CONHC_2H_4NH_2$ wherein $R_1$ is an alkyl group containing about 8 to 20 carbon atoms, such as N-2-amino ethylstearyl amide and N-amino ethylmyristyl amide; quaternary ammonium compounds wherein typically one of the groups linked to the nitrogen atom is an alkyl group containing about 8 to 22 carbon atoms and three of the groups linked to the nitrogen atom are alkyl groups which contain 1 to 3 carbon atoms, including alkyl groups bearing inert substituents, such as phenyl groups, and there is present an anion such as halogen, acetate, methosulfate, etc. The alkyl group may contain intermediate linkages such as amide which do not substantially affect the hydrophobic character of the group, for example, stearyl amido propyl quaternary ammonium chloride. Typical quaternary ammonium detergents are ethyl-dimethyl-stearyl-ammonium chloride, benzyl-dimethyl-stearyl ammonium chloride, trimethyl-stearyl ammonium chloride, trimethyl-cetyl ammonium bromide, dimethylethyl-lauryl ammonium chloride, dimethyl-propyl-myristyl ammonium chloride, and the corresponding methosulfates and acetates.

Ampholytic detergents are also suitable for the invention. Ampholytic detergents are well known in the art and many operable detergents of this class are disclosed by A. M. Schwartz, J. W. Perry and J. Birch in "Surface Active Agents and Detergents," Interscience Publishers, New York, 1958, vol. 2. Examples of suitable amphoteric detergents include: alkyl betaminodipropionates, $RN(C_2H_4COOM)_2$; alkyl beta-amino propionates, $RN(H)C_2H_4COOM$: and long chain imidazole derivatives having the general formula:

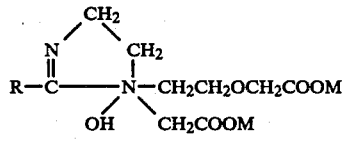

wherein in each of the above formulae R is an acyclic hydrophobic group containing from about 8 to 18 carbon atoms and M is a cation to neutralize the charge of the anion. Specific operable amphoteric detergents include the disodium salt of undecylcycloimidiniumethoxyethionic acid-2-ethionic acid, dodecyl beta alanine, and the inner salt of 2-trimethylamino lauric acid.

The bleaching detergent compositions of the invention optionally contain a detergent builder of the type commonly used in detergent formulations. Useful builders include any of the conventional inorganic water-soluble builder salts, such as, for example, water-soluble salts of phosphates, pyrophosphates, orthophosphates, polyphosphates, silicates, carbonates, and the like. Organic builders include water-soluble phosphonates, polyphosphonates, polyhydroxysulfonates, polyacetates, carboxylates, polycarboxylates, succinates and the like.

Specific examples of inorganic phosphate builders include sodium and potassium tripolyphosphates, pyrophosphates and hexametaphosphates. The organic polyphosphonates specifically include, for example, the sodium and potassium salts of ethane 1-hydroxy-1, 1-diphosphonic acid and the sodium and potassium salts of ethane-1, 1, 2-triphosphonic acid. Examples of these and other phosphorous builder compounds are disclosed in U.S. Pat. Nos. 3,213,030; 3,422,021; 3,422,137 and 3,400,176. Pentasodium tripolyphosphate and tetrasodium pyrophosphate are especially preferred water-soluble inorganic builders.

Specific examples of non-phosphorous inorganic builders include water-soluble inorganic carbonate, bicarbonate and silicate salts. The alkali metal, for example, sodium and potassium, carbonates, bicarbonates and silicates are particularly useful herein.

Water-soluble organic builders are also useful. For example, the alkali metal, ammonium and substituted ammonium polyacetates, carboxylates, polycarboxylates and polyhydroxysulfonates are useful builders for the compositions and processes of the invention. Specific examples of polyacetate and polycarboxylate builders include sodium, potassium, lithium, ammonium and substituted ammonium salts of ethylene diaminetetracetic acid, nitrilotriacetic acid, benzene polycarboxylic (i.e. penta- and tetra-) acids, carboxymethoxysuccinic acid and citric acid.

Water-insoluble builders may also be used, particularly, the complex silicates and more particularly, the complex sodium alumino silicates such as, zeolites, e.g., zeolite 4A, a type of zeolite molecule wherein the univalent cation is sodium and the pore size is about 4 Angstroms. The preparation of such type zeolite is described in U.S. Pat. No. 3,114,603. The zeolites may be amorphous or crystalline and have water of hydration as known in the art.

The use of inert, water-soluble filler salts is desirable in the compositions of the invention. A preferred filler salt is an alkali metal sulfate, such as, potassium or sodium sulfate, the latter being especially preferred.

Various adjuvants may be included in the bleaching detergent compositions of the invention. For example, colorants, e.g., pigments and dyes; antiredeposition agents, such as, carboxymethylcellulose; optical brighteners, such as, anionic, cationic and nonionic brighteners; foam stabilizers, such as, alkanolamides; proteolytic enzymes; perfumes and the like are all well known in the fabric washing art for use in detergent compositions.

A preferred composition in accordance with the invention typically comprises (a) from about 2 to 50%, by weight, of a bleaching agent comprising a peroxyacid compound and/or a water-soluble salt thereof; (b) from about 0.1 to about 5%, by weight, of a polymer containing momomeric units of the formula

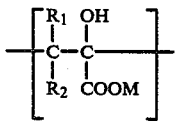

wherein $R_1$ and $R_2$ represent hydrogen or an alkyl group containing from 1 to 3 carbon atoms, and M represents hydrogen, or an alkali metal, an alkaline earth metal or ammonium cation; (c) from about 3 to about 50%, by weight, of a detergent surface active agent; (d) from about 1 to about 60%, by weight, of a detergent builder salt; and (e) from about 0 to about 10%, by weight, of a non-polymeric sequestering agent. The balance of the composition will predominantly comprise water, filler salts, such as, sodium sulfate, and minor additives selected from among the various adjuvants described above.

The bleaching detergent compositions of the invention are particulate compositions which may be produced by spray-drying methods of manufacture as well as by methods of dry-blending or agglomeration of the individual components. The compositions are preferably prepared by spray drying an aqueous slurry of the nonheat-sensitive components to form the spray-dried particles, followed by admixing such particles with the heat-sensitive components, such as the bleaching agent (i.e., the peroxygen compound and organic activator) and adjuvants such as perfume and enzymes. Mixing is conveniently effected in apparatus such as a rotary drum. The particular poly-alpha-hydroxyacrylate to be used in the bleaching detergent compositions is conveniently formed by introducing a precurser thereof in the form of a polylactone into the crutcher slurry where it is hydrolyzed and then neutralized (generally with NaOH) to form the sodium poly-alpha-hydroxyacrylate as a component of the spray-dried detergent particles.

The bleaching detergent compositions of the invention are added to the wash solution in an amount sufficient to provide from about 3 to about 100 parts of active oxygen per million parts of solution, a concentration of from about 5 to about 40 ppm being generally preferred.

EXAMPLE 1

A preferred bleaching detergent composition is comprised of the following:

| Component | Weight Percent |
|---|---|
| Sodium linear $C_{10}$–$C_{13}$ alkyl benzene sulfonate | 5 |
| Ethoxylated $C_{11}$–$C_{18}$ primary alcohol (11 moles EO per mole alcohol) | 3 |
| Soap (sodium salt of $C_{12}$–$C_{22}$ carboxylic acid) | 5 |
| Pentasodium tripolyphosphate (TPP) | 40 |
| EDTA | 0.5 |
| Sodium silicate | 3 |
| Sodium PLAC[1] | 1 |
| Monoperoxyphthalic acid (MPPA) (Magnesium salt) | 6 |
| Optical brighteners and pigment | 0.2 |
| Perfume | 0.3 |
| Proteolytic enzymes | 0.3 |
| Sodium sulfate and water | balance |

[1]A designation used herein for sodium poly-alpha-hydroxyacrylate.

The foregoing product is produced by spray-drying an aqueous slurry containing 60%, by weight, of a mixture containing all of the above components except the enzyme, perfume, and magnesium salt of MPPA; the sodium PLAC is not introduced as such into the aqueous slurry, but rather, a precursor thereof, the polylactone corresponding to the dehydration product of polyhydroxyacrylic acid is introduced into the crutcher where it hydrolyzes and is neutralized to form the sodium PLAC in the spray-dried powder. The resultant particulate spray dried product has a particle size in the range of 14 mesh to 270 mesh, (U.S. Sieve Series). The spray dried product is then mixed in a rotary drum with the appropriate amounts of MPPA, enzymes and perfume to yield a particulate product of the foregoing composition having a moisture of approximately 13%, by weight.

The above-described product is used to wash soiled fabrics by hand-washing as well as in a washing machine, and good laundering and bleaching performance is obtained for both methods of laundering.

Other satisfactory products can be obtained by varying the concentrations of the following principal components in the above-described composition as follows:

| Composition | Weight Percent |
|---|---|
| Alkyl benzene sulfonate | 4–12 |
| Ethoxylated alcohol | 1–6 |
| Soap | 1–10 |
| TPP | 15–50 |
| Enzymes | 0.1–1 |
| EDTA | 0.1–2 |
| MPPA | 2–15 |
| Sodium PLAC | 0.1–5 |

For highly concentrated heavy duty detergent powder, the alkyl benzene sulfonate and the soap components in the above-described composition may be deleted, and the ethoxylated alcohol content may be increased to an upper limit of 20%.

EXAMPLE 2

Bleaching tests are carried out as described below comparing the bleaching performance of bleaching detergent compositions which are similar except for the amount of sodium poly-alpha-hydroxyacrylate (hereinafter "sodium PLAC") in the composition. The compositions are formulated by post-adding to a spray-dried detergent composition, granules of a bleaching composition containing magnesium monoperoxyphthalate to form the bleaching detergent compositions shown in Table 1 below. The numbers indicated in the Table 1 represent the percentage of each component, by weight, in the composition.

TABLE 1

| Component | Composition A | Composition B |
|---|---|---|
| Sodium linear $C_{10}$–$C_{13}$ alkyl benzene sulfonate | 5% | 5% |
| Ethoxylated $C_{11}$–$C_{18}$ primary alcohol (11 moles) EO per mole alcohol) | 3 | 3 |
| Soap (sodium salt of $C_{12}$–$C_{22}$ carboxylic acid) | 5 | 5 |
| Sodium silicate ($1Na_2O:2SiO_2$) | 3 | 3 |
| Sodium PLAC | 0.0 | 1.0 |
| Pentasodium tripolyphosphate (TPP) | 40 | 40 |
| Optical brightener (stilbene) | 0.2 | 0.2 |
| H-48(1) | 7 | 7 |
| EDTA(2) | 0.0 | 0.5 |
| Sydex(3) | 0.2 | 0.0 |
| Enzymes | 0.3 | 0.3 |
| Sodium sulfate and water | balance | |

(1)A bleaching composition sold by Interox Chemicals Limited, London, England containing about 65 wt. % magnesium monoperoxyphthalate, 11 wt. % magnesium perthalate, balance $H_2O$.
(2)Ethylene diamine tetraacetic acid.
(3)A tradename of a chelating material comprised of magnesium silicate and magnesium diethylenetriamine pentaacetic acid.

TEST PROCEDURE

Bleaching tests are carried out in an Ahiba apparatus at a maximum temperature of 60° C., as hereinafter described, 600 ml of tap water having a water hardness of about 320 ppm, as calcium carbonate, are introduced into each of six buckets of the Ahiba. Six cotton swatches (8 cm × 12 cm) soiled with immedial black or wine are introduced into each bucket, the initial reflectance of each swatch being measured with a Gardner XL 20 reflectometer.

Six grams each of compositions A and B (described in Table 1) are introduced separately into the six buckets of the Ahiba, a different composition being introduced into each bucket. The bleaching detergent compositions are thoroughly mixed in each bucket with a blender-type apparatus and the wash cycle thereafter initiated. The bath temperature, initially at 30° C., is allowed to rise about 1° Centigrade per minute until the maximum test temperature of 60° C. is reached, such maximum temperature being then maintained for about 15 minutes. The buckets are then removed and each swatch washed twice with cold water and dried.

The final reflectance of the swatches are measured and the difference (ΔRd) between the final and initial reflectance values is determined. An average value of ΔRd for the six swatches in each bucket is then calculated. The results of the bleaching tests are set forth below in Table 2, the values of ΔRd being provided as an average value for the particular composition and test indicated.

TABLE 2

| SOIL | Δ Rd (Average) Max. Ahiba Temperature of 60° C. 0% Sodium PLAC (A) | 1.0% Sodium PLAC (B) |
|---|---|---|
| IMMEDIAL BLACK | 3.5 | 3.9 |
| WINE | 33.7 | 34.3 |

As indicated in Table 2, composition B which contains sodium PLAC provided an improved bleaching performance relative to composition A which is substantially similar thereto except for the absence of sodium PLAC and EDTA.

What is claimed is:

1. A particulate bleaching detergent comprising:
(a) from about 2 to about 50%, by weight, of a bleaching agent comprising a peroxyacid compound and/or a water-soluble salt thereof;
(b) from about 0.1 to about 5%, by weight, of a polymer containing monomeric units of the formula

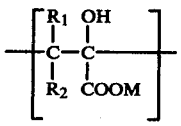

wherein $R_1$ and $R_2$ independently represent hydrogen or an alkyl group containing from 1 to 3 carbon atoms, and M represents hydrogen, or an alkali metal, an alkaline earth metal or ammonium cation;
(c) from about 3 to 50%, by weight, of at least one detergent surface active agent selected from the group consisting of anionic, cationic, nonionic, ampholytic and zwitterionic detergents;
(d) from about 0 to about 10%, by weight, of a non-polymeric sequestering agent; and
(e) from about 1 to about 60%, by weight, of a detergent builder salt other than that defined in (b) and (d); and
(f) the balance comprising water and optionally filler salts.

2. A composition in accordance with claim 1 wherein said polymer is an alkali metal poly-alpha-hydroxyacrylate.

3. A composition in accordance with claim 2 wherein the concentration of polymer is from about 0.5 to about 3%, by weight.

4. A composition in accordance with claim 1 wherein said bleaching agent comprises magnesium momoperoxyphthalate.

5. A composition in accordance with claim 1 wherein said sequestering agent comprises ethylenediamine tetraacetic acid.

6. A process for bleaching which comprises contacting the stained and/or soiled material to be bleached with an aqueous solution of a particulate bleaching detergent composition comprising:

(a) from about 2 to 50%, by weight, of a bleaching agent comprising a peroxyacid compound and/or a water soluble salt thereof;

(b) from about 0.1 to about 5%, by weight based on the weight of said detergent composition, of a polymer containing momomeric units of the formula

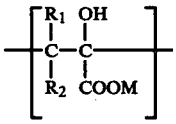

wherein $R_1$ and $R_2$ independently represent hydrogen or an alkyl group containing from 1 to 3 carbon atoms, and M represents hydrogen, or an alkali metal, an alkaline earth metal or ammonium cation; and (c) from about 3 to 50%, by weight, of at least one surface active agent selected from the group consisting of anionic, cationic, nonionic, ampholytic and zwitterionic detergents.

7. The process of claim 6 wherein said composition additionally contains a builder salt other than that defined in (b) in an amount of from about 1 to 60%, by weight.

8. The process of claim 7 wherein said composition additionally contains a non-polymeric sequestering agent.

9. The process of claim 8 wherein said sequestering agent is EDTA.

10. The process of claim 7 wherein said bleaching agent comprises magnesium monoperoxyphthalate.

11. The process of claim 7 wherein said polymer is an alkali metal poly-alpha-hydroxyacrylate.

12. The process of claim 7 wherein the concentration of polymer in said composition is from about 0.5 to about 3%, by weight.

* * * * *